United States Patent [19]

Chang

[11] Patent Number: 4,489,530

[45] Date of Patent: Dec. 25, 1984

[54] SANDWICH WALL STRUCTURE AND THE METHOD FOR CONSTRUCTING THE SAME

[76] Inventor: Chi Ming Chang, 5Fl., 22, Ln. 618, Min Chuan East Rd., Taipei, Taiwan, Taiwan

[21] Appl. No.: 333,795

[22] Filed: Dec. 23, 1981

[51] Int. Cl.[3] ..... E04F 13/04; E04G 21/12; E04G 21/00

[52] U.S. Cl. ..... 52/741; 52/238.1; 52/240; 52/243; 52/309.11; 52/309.12; 52/383; 52/410; 52/744

[58] Field of Search ..... 52/309.11, 309.12, 238.1, 52/240, 243, 354, 356, 410, 744, 741

[56] References Cited

U.S. PATENT DOCUMENTS

| | | | |
|---|---|---|---|
| 515,496 | 2/1894 | Mela | 52/243 X |
| 670,809 | 3/1901 | Perry | 52/348 X |
| 734,781 | 7/1903 | Walker et al. | 52/241 X |
| 916,356 | 3/1909 | Myers | 52/356 |
| 943,696 | 12/1909 | Mooney et al. | 52/356 |
| 1,350,633 | 8/1920 | Allsworth | 52/354 |
| 1,603,699 | 10/1926 | Lawrence | 52/238.1 X |
| 2,104,873 | 1/1938 | Levy | 52/241 |
| 2,718,138 | 9/1955 | Jones | 52/410 X |
| 3,680,271 | 8/1972 | Satchell | 52/241 X |
| 4,179,858 | 12/1979 | Graham et al. | 52/744 |
| 4,253,288 | 3/1981 | Chun | 52/309.12 X |

*Primary Examiner*—Alfred C. Perham
*Attorney, Agent, or Firm*—Armstrong, Nikaido, Marmelstein & Kubovcik

[57] ABSTRACT

Method of making an improved sandwich type insulation wall having internal framework formed by channel bars and transverse members bridging two adjacent channel bars. A plurality of channel bars having lateral wings are erected to form the main skeleton; the spaces between the channel bars are filled with pieces of resilient insulating material of proper size and shape by inserting their edges into the channels of the bars to secure them in place; transverse members are positioned at both sides of the insulating material between and connected to the channel bars; wire panels are mounted to cover the whole area of the wall spaced from the insulating board by the wings and transverse members; and both sides of the structure are grouted with a proper thickness of grouting cement or vermiculite.

10 Claims, 11 Drawing Figures

SANDWICH WALL STRUCTURE AND THE METHOD FOR CONSTRUCTING THE SAME

This invention relates to an improvement in a wall structure and the method for constructing the same, and in particular, to a sandwich-type wall.

A wall structure having a core of light, resilient insulating material and a wire framework reinforcement is disclosed in U.S. Pat. No. 3,305,991 and U.S. Pat. No. 3,555,131. Although the structure shown therein is an improvement, it still suffers from several drawbacks. Typically, such walls are prefabricated rather than constructed in situ. This is done by inserting elongate pieces of insulating material, e.g. formed polyethylene, into a wire framework and grouting both sides of the so-formed entity with a proper thickness of cement. It is costly and takes much labor to fabricate the wire framework and to properly position and locate the elongate pieces. Such a wire-caged foam assembly is pre-fabricated in a plant, not prepared in situ. Hence, it is made to definite, inflexible specification. Constrained by this inflexible specification, such a construction is not adapted to enable windows to be put into the wall at desired sites with desired sizes and shapes. If the horizontal dimension of a desired window or door is not exactly a multiple of the width of an elongate piece, there will always exist a problem of "remainder". For example, if each elongate piece is two inches wide, and the desired width of the window is two feet, three inches, a remainder of one inch is left where the framework is cut. The split one-inch wide elongate piece cannot be retained in place. Under such a circumstance, the positioning and dimensioning of doors and windows always must yield to the restriction of initial specification of the prefabricated wall. A similar problem exists in the joining of separate walls. Being prefabricated, the wall cannot be made too large, otherwise transportation of the wall will be difficult. Thus a comparatively large wall can only be formed by joining several smaller walls together to form an entity. Since the wire framework of the resulting wall is not an integral whole, the site where the two separate smaller walls join with each other is the weak point of the wall. Such a weak point is extremely susceptible to fracture or fissure. Therefore such prefabricated wall structure is only adapted well to be used for partition walls, but gives a poor result when used as an exterior wall. Also, the leftover materials resulting from the aforesaid problem of "remainder" cannot be utilized, and must be discarded, therefore causing considerable waste of material. Further, it is more difficult and laborious to form a continuous groove along a wall which contains several separate elongate insulating pieces than to form such a groove along a wall of one integral piece to set pipes for supplying water or gas or for passing electrical wires.

Accordingly, it is the object of this invention to provide an improved sandwich insulating wall which obviates or mitigates the disadvantages of the above prior art wall while keeping all the advantages thereof.

SUMMARY

The above object is obtained in the following of method of constructing a wall of improved structure. Firstly, a plurality of channel bars having lateral wings are spaced vertically and horizontally from each other to form the backbone of the wall. Each of the oblong or square vacancies between the spaced channel bars is filled with a whole piece of continuous insulating board of light, resilient material, for example, foamed polyphenylethylene, with at least one of the side edges of the board fitted into the channels of the bars. Then a plurality of transverse members are fitted across each pair of spaced bars to further retain the insulating board therebetween. Both sides of the planar structure thus formed are respectively panelled with a wire panel. Preferably a clearance is left between the wire panels and the insulating board. Such a clearance wherently produced by the wings of the bars and the transverse members. Finally, the structure is grouted by conventional means, thus finishing the construction. The thickness of grouting cement is preferrably 2.5 cm, thus the aforesaid clearance is preferably about half of that much, i.e. 1.3 cm or so. Preferably, grouting put on in two layers is instead of being finished at one time to obtain a better result.

BRIEF DESCRIPTION OF THE DRAWINGS

Other objects and advantages of the present invention will become more apparent to those persons skilled in this art to which the present invention pertains from the following description taken in conjunction with the accompanying drawings, therein:

FIG. 2 to FIG. 6 shows the sequence of assembling the wall, in which:

FIG. 2 is a perspective view showing the insulating boards and channel bars;

FIG. 3 is a perspective view showing the channel bar and bar coupler;

FIG. 4 is a partial perspective view showing the framework formed by channel bars interconnected by means of the couplers;

FIG. 5 is a perspective view showing the mounting of the transverse members;

FIG. 6 is a perspective view showing the mounting of the wire panels;

FIG. 6-1 shows an enlarged view of an exemplary clip for securing the wire panels;

FIG. 6-A is an elevational view showing the framework of channel bars in which spaces are reserved for a door and a window respectively;

DETAILED DESCRIPTION OF PREFERRED EMBODIMENT

Figure 1:
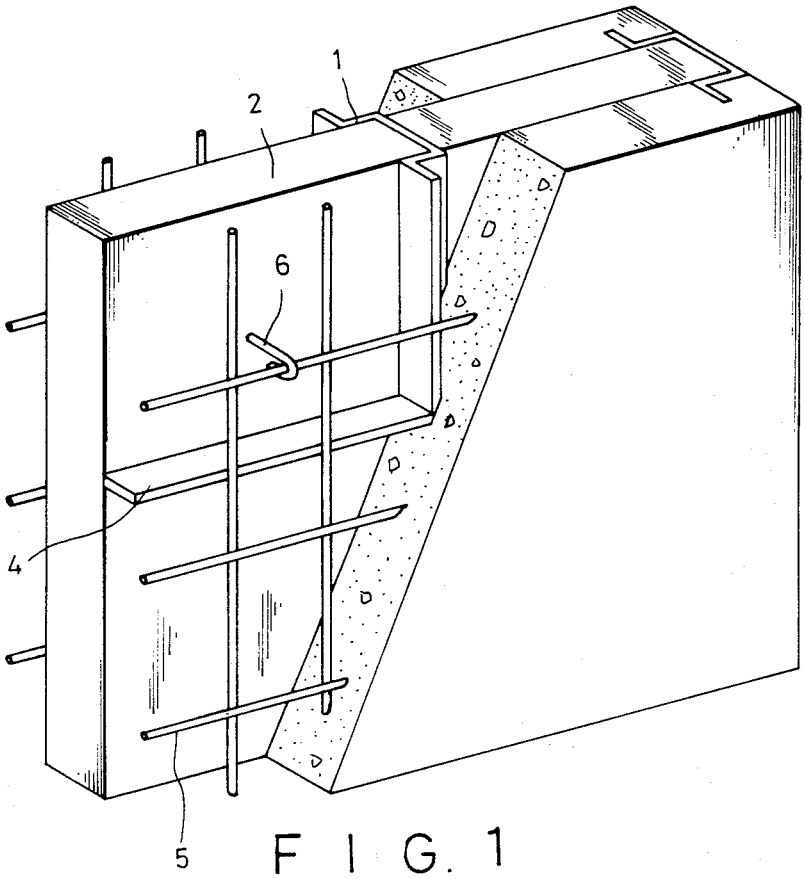
FIG. 1 is a partially cutaway view of a wall according to this invention.
Figure 2:
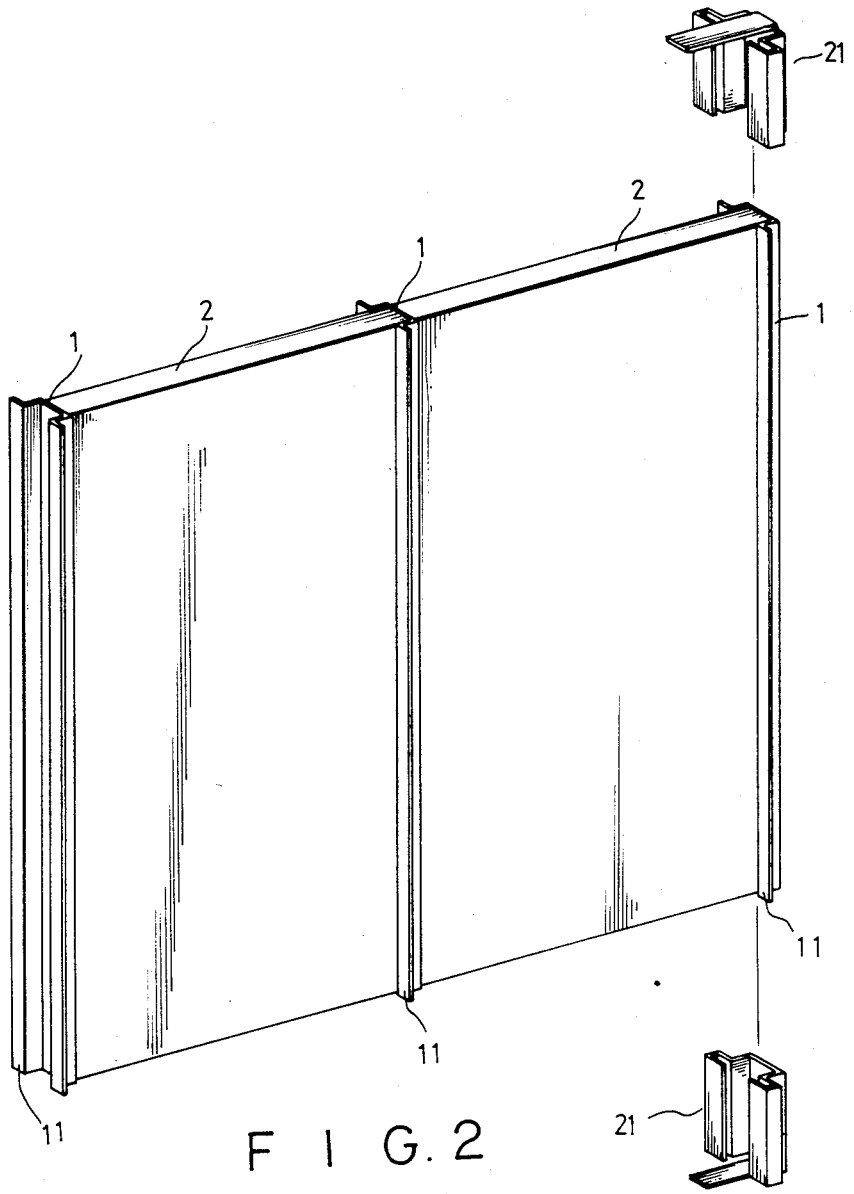
Figure 3:
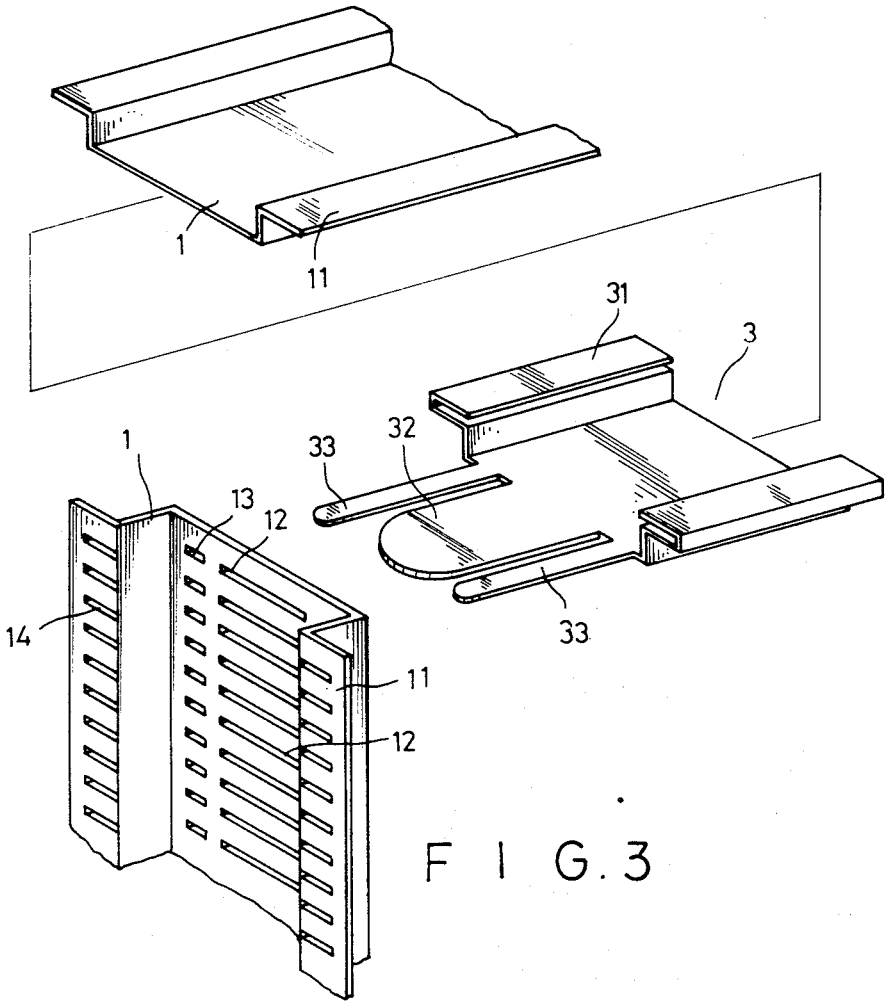

Referring now to FIG. 1, a partially cutaway view of a wall according to this invention is shown, in which part of the crust of concrete is removed to reveal the internal structure. As shown in FIG. 2, to construct such a wall, a plurality of spaced channel bars 1 of proper length having lateral wings are selected. End caps 21 are fitted onto the upper and lower ends of the channel bars. The capped bars are erected and fixed to the ceiling and the floor by rivetting or nailing through the tabs on the caps 21. In so doing, the framework of the wall is made to be an integral part of the framework of the whole building. Then insulating boards 2 of proper size are fitted to coincide with and snugly fill up the vacant spaces between the spaced bars. Preferably, the insulating boards 2 are formed of light, resilient material, e.g. foamed polyphenylethylene. The thickness of the board is substantially the width of the channel of channel bar 1.

In addition to the vertical installation of channel bars 1 as described above, other channel bars 1 can be horizontally mounted to bridge between the spaced vertical channel bars 1 to reinforce the frame and to simplify the installation of windows and/or doors.

Figure 4:
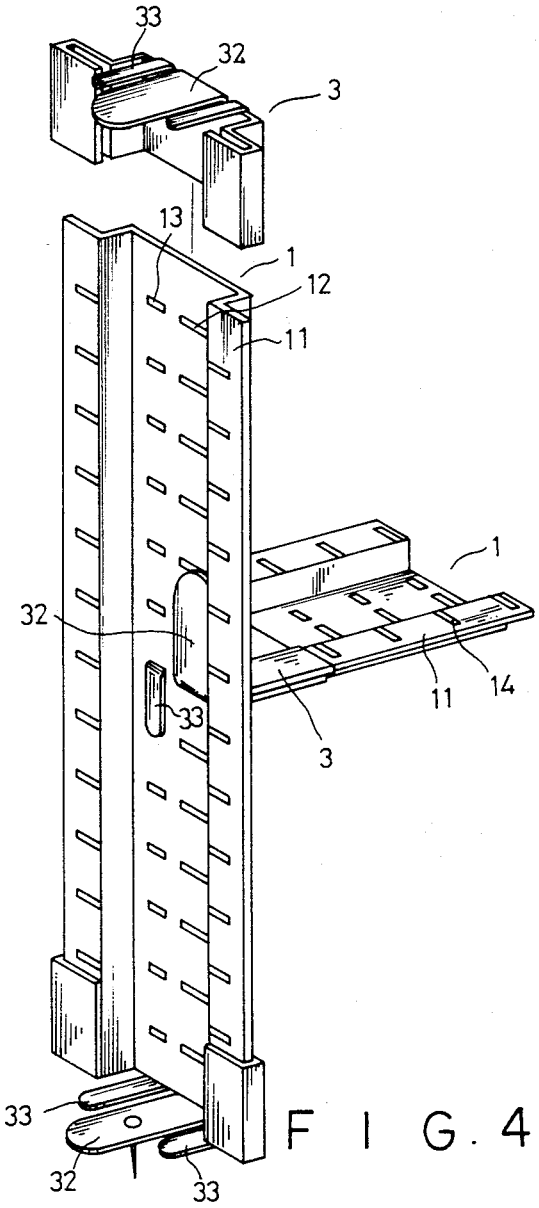
Figure 5:
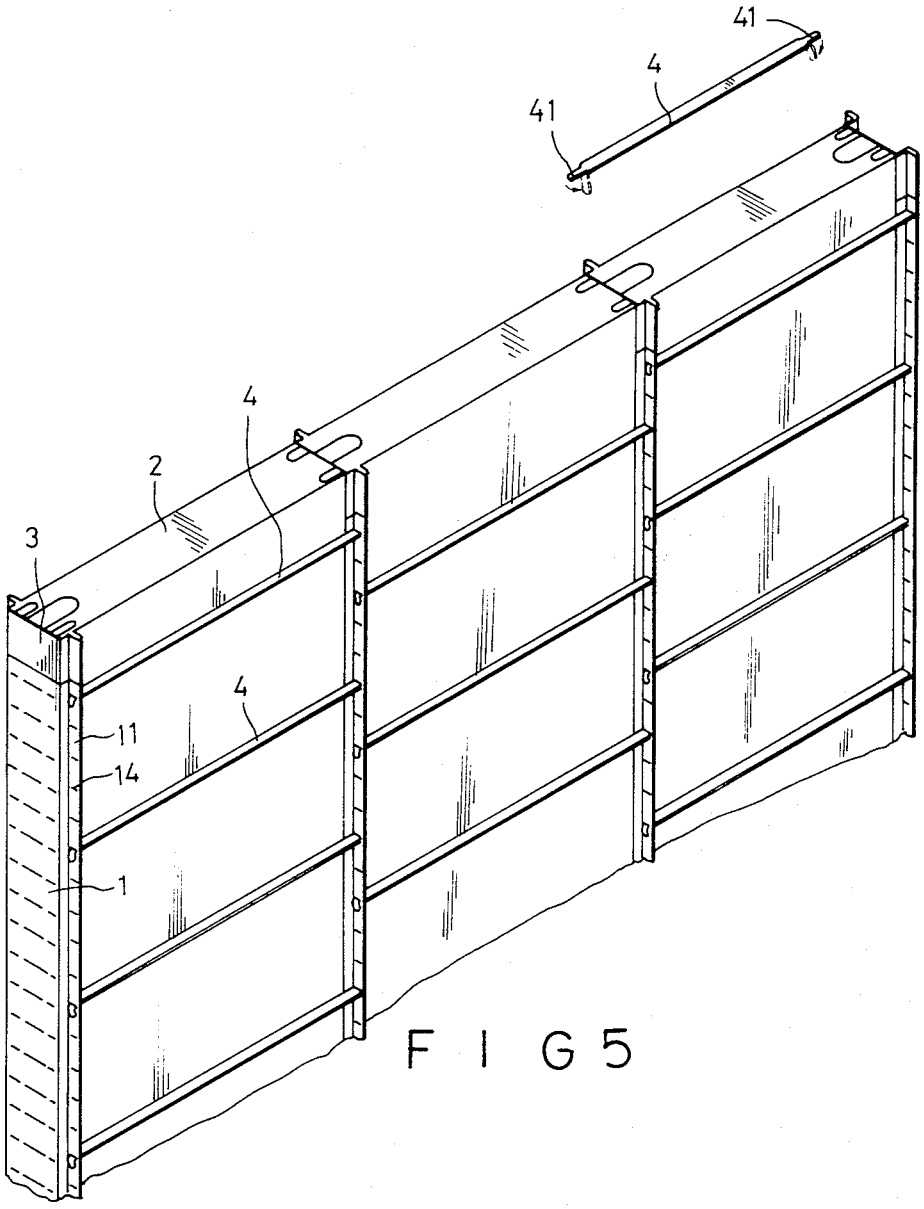

What is shown in FIG. 1 and FIG. 2 is a simplest prototypes of channel bar 1, having two flange-like lateral wing portions 11 extending along the entire length of bar. However, to facilitate the assemblage of the elements, the channel and the wings can be provided with a plurality of transversely running slots 12, 13, 14. The slots 12, 13 are provided to receive tongues 32, 33 of coupler 3. The slots 14 are provided to mount transverse members. To couple two channel bars perpendicularly, the tongues 32, 33 of bar coupler 3 are inserted into corresponding slots 12, 13 in the channel bar. The middle tongue 32 and side tongues are then bent in opposite directions (See FIG. 4) so as to secure the coupler 3 to the channel bar. Corresponding to the wing portions 11 of channel bar 1, the two sides of coupler 3 are folded inwardly to define two open sleeves 31 which are adapted to receive the wing portions of the coupled channel bar. To couple the channel bars, the second channel bar rested into the coupler with concave sides facing to the same direction. The site and number of such couplings may vary, depending on actual necessity. Desired channel bars are suitably cut into proper size in the field before they are assembled, and are joined at desired sites. Coupler 1 may also be used as an end cap by bending all its tongues in the same direction (See FIG. 4).

Transverse members 4 are slender metallic strips having thin end portions 41. They are mounted to the framework by inserting the end portions 41 into the slots 14 of the wing portions 11 of two spaced channel bars 1 at desired sites. The end portions 41 are then bent to secure the members 14 in position. Each transverse member 4 has three functions. Firstly, it serves to interconnect the spaced channel bars. Secondly, it helps retain the insulating board in position, and in cooperation with the wing portions of the channel bar, helps ensure that the desired clearance between the insulating board and the wire panel is maintained so as to allow the wire panel to be thoroughly enclosed in the concrete layer without touching the insulating board to enhance tolerance to stresses. Thirdly, in the first grouting, the transverse member of the wall helps to hold the cement slurry to prevent the downward sliding thereof by gravitation before the cement solidifies.

Figure 6:
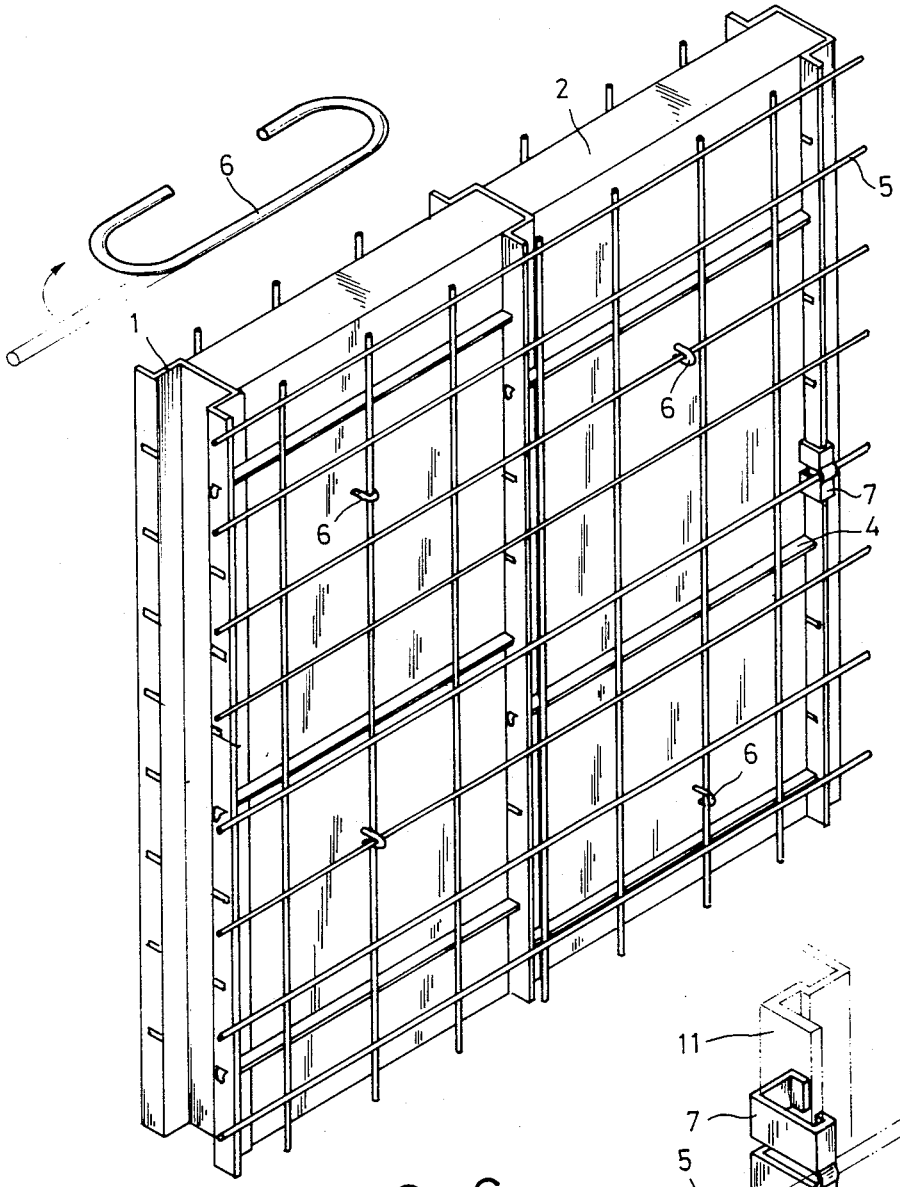
Figures 1, 6:
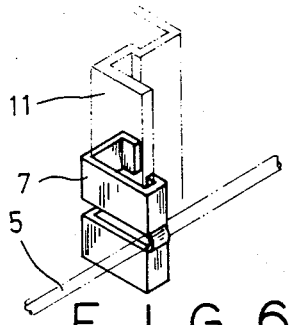
Figure 6A:
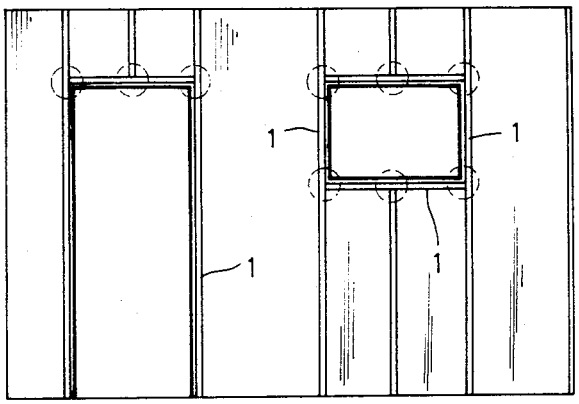

The next step is to mount the wire panels 5 to the two sides of the flat structure (See FIG. 6). Held against the edges of the outwardly extending wings 11 and the transverse members 4, the panels 5 are spaced apart from the insulating board 2 by a clearance which depends on the width of wings 11 and transverse member 4. To secure the wire panels in place, a J-shaped hook 6, which has a straight end and a curve-in end that defines a hook, is used. First a wire panel 5 is located in desired position and the straight end of hook 6 is pushed to pierce through insulating board with its curve end catching and holding the wire panel. The straight end emerging from the opposite side is then bent the hook the another wire panel 5 on the opposite side of the wall.

To secure the wire panel 5 to the channel bars 1, a plurality of slotted clips 7 are used (FIG. 6-1). The slotted clips 7 have an L-shaped slot which opens at one end to allow the entry of the wire panel. All the aforesaid steps, except for fixing the bars to the ceiling or floor structure, can be conveniently done manually by a half-skilled or even unskilled worker without any special tools. Each individual member is light in weight, not exceeding a man's average ability of load, so that one can carry the member from one spot to another with ease.

The final step is to grout the structure by conventional means, e.g. by shotcrete grouting or by hand.

All of the foregoing bar couplers 3, transverse member 4, hooks 6, and clips 7 are merely examples to show possible useable structure, and are not intended to be limiting. For example, the clips 7 can be structured to be inserted into the slots of the wing portions of the channel bars.

Referring to FIG. 6-A, to make doors or windows on the wall, the desired site is firstly outlined by proper channel bars to leave an empty space without insulating board to define a door or a window. After the wire panels 5 are mounted, to corresponding area of the wires located over the empty space of the would-be windows or doors is cut off.

To cope with the different design requirements for the strength of the wall, the design of this invention is highly flexible. Its strength may be varied by changing the thickness or number of the channel bars or by properly selecting wire panels of different thickness or meshes.

Figure 7:
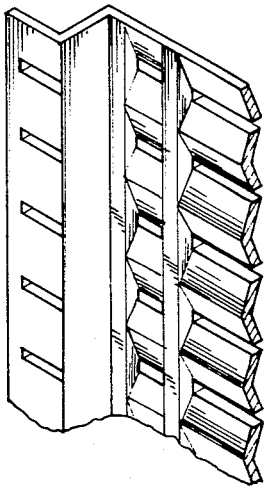
FIG. 7 is a partial perspective view of a split channel bar of improved type.
Figure 9:
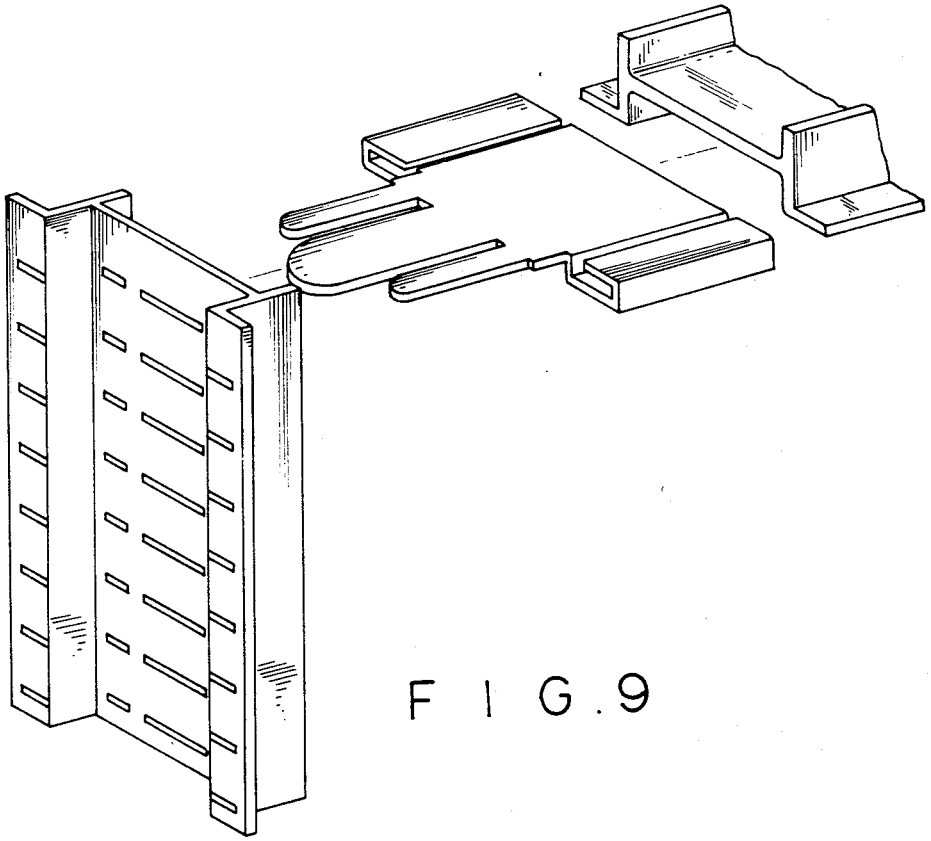
FIG. 9 is a partial perspective view of two H-channel bars and a corresponding coupler.

To enhance the strength of channel bar, it can be modified to have a corrugated or pleated channel bed (See FIG. 7). Also, the coupling effect will be considerably bettered if a narrow recess 111 is formed at the base of each wing portion 11 of the channel bar to receive a corresponding inwardly protruding flange 311 formed at the opening of the open sleeve 31 of bar coupler 3.

Figure 8:
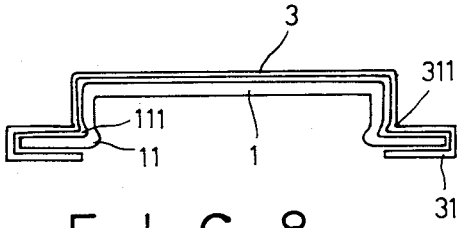
FIG. 8 is a partial sectional view showing an engagement of another improved type of channel bar and a corresponding coupler.

The channel bar 1 may be modified to have an H-shaped cross section instead of the U-shaped section. This design is stronger and retains the insulating board better, for one such bar provides two channels rather than one. However, the shape of a suitable end cap or coupler must be properly modified. Also, the modification shown in FIG. 8 can be applied to the H-shaped channel bar.

None of the conventional wall structures can be said to be ideal because they all suffer from their respective defects. A brick wall lacks elasticity and is extremely vulnerable to shear. A reinforced concrete wall is costly and takes much time to build because several kinds of skilled workers are indispensibly involved, including reinforcement rod setters, masons, concrete formers, brick layers and plasterers. This also considerably increases the cost of labor. Moreover, since such wall structures are heavy in weight, the resulting building must have a very strong foundation. This indirectly increases the cost. The above disclosed prior art sandwich type insulating walls, although free of these drawbacks, are nevertheless unsatisfactory because of their structural defects. To make the comparison between this invention and the prior art, the differences are summarized as follows:

TABLE 1

| Comparison Between Present Invention And The Prior Art | | |
|---|---|---|
| | Present Invention | Prior Art |
| 1. manner of construction | can be built up in situ | can only be prefabricated |
| 2. Cost of: | | |
| (a) formation of parts | low | high |
| (b) transportation | low | high |
| 3. Structure | with framework of channel bars, the abutment of two adjacent insulating boards, where there lies a channel bar, makes the strongest portion of the inner core. | with a framework, the abutment of two adjacent insulating pieces is a weak "dead corner", of the inner core |
| 4. Constraint of design due to specification | design is highly flexible not restricted by specification. | highly specified material must be selected to match the design. |
| 5. To build a large wall | the whole wall forms an integral entity, leaving no dead corners. | several smaller walls are joined together, leaving their abutments as the weakest portion. |
| 6. Easiness of operation | very easy in cutting, fenestration and piping. | difficult to cut, fenestrate or set pipes |
| 7. Waste of material | very little waste of cutoff | considerable useless leftover |
| 8. Scale up | very free, the structure can be strengthened by varying the number of thickness of channel bars | very difficult in whatever height or width |

Tables 2 to 4 present data of some tests of this invention.

TABLE 2

| Test Of The Ability To Withstand Stress Sample: 35.6 cm × 35.9 cm × 11.0 cm | |
|---|---|
| 1. Density (g/cm$^3$) | 1.347 |
| 2. Axial resistance to pressure (kg/m) | 22,535 |
| 3. Transverse resistance | 383,411 |
| 4. Resistance to bending | 27.0 |

TABLE 3

Axial Load Test

| Sample | Specification | Maximal Load (Tons) | Deformation at Maximal load (mm) | Max. line Load (ton/m) |
|---|---|---|---|---|
| 1 | 63 × 96 (cm) | 6.88 | 12.41 | 10.92 |
| 2 | 4 × 8 (ft) | 18.85 | 21.36 | 14.64 |
| 3 | 4 × 8 (ft) | 25.54 | 21.46 | 20.95 |

| Test | Temperature of the heating side (°C.) | Temperature of the opposite side (°C.) | Heating time hour: minute | Observed result |
|---|---|---|---|---|
| First burning | 100 | — | 0:20 | No combustible gas is found liberated during the burning. After cooling the heated side has very tiny T-shaped fissure, but no flaking is observed |
| | 200 | 84 | 1:05 | |
| | 300 | 90 | 1:50 | |
| | 340 | 120 | 3:00 | |
| Second burning (with the sample enclosed by 3 cm of glass wool at four sides, and by 6 cm of glass wool at the back-side) | 100 | 30 | 0:16 | No combustible gas is found liberated during the burning. Tiny fissures are found at both the heated side and the back side, but no cracks or flaking are found. |
| | 200 | 40 | 0:30 | |
| | 300 | 90 | 0:55 | |
| | 400 | 190 | 1:42 | |
| | 440 | 300 | 2:17 | |
| | 500 | — | 3:34 | |
| | 540 | — | 7:20 | |

After cooling, load was applied to the side of the sample (30×10 cm) The maximal load was 11,200 kg and the resistance to pressure was 37.3 kg/cm$^2$ (531 psi).

I claim:

1. A method for constructing a wall having a core of light, resilient, heat-insulating material with a framework of metallic bars and two wire-reinforced crusts of concrete at both sides of said core, comprising:

vertically erecting a plurality of metal channel bars, each of which defines at least one channel and has wings extending transversely distally a small distance along its entire length, in spaced relationship to construct a substantially planar framework and fixing the framework to a horizontal surface structure of a building; filling empty spaces thus defined between said spaced bars with pieces of light, resilient heat-insulating material, with an edge of each said insulating piece fitted in one of said channels; mounting a plurality of transverse members to said wings of each of two adacent channel bars over outside of surface of said insulating pieces mounting wire panels onto opposite sides of said insulating pieces with a clearance between the wire panel and the insulating pieces defined by said wings of said channel bars and said transverse members;

grouting the two pannelled sides to form said two wire-reinforced concrete crusts on both sides of said insulating pieces.

2. The method according to claim 1, wherein the step of erecting said channel bars includes installing horizontal channel bars at positions where openings in said wall are desired.

3. The method according to claim 1, wherein said channel bar has a substantially U-shaped cross-section.

4. The method according to claim 2, wherein the installing of the horizontal channel bars includes joining two perpendicular channel bars together by sliding an end of one of the channel bars into a bar coupler shaped to have a channel at the middle portion and two outwardly extending open sleeves so that said end of channel bar can be received therein with its two wings inside said two open sleeves respectively and connecting the bar coupler to the other channel bar.

5. The method according to claim 4 further comprising, providing one end of said bar coupler with at least two tongues; and providing a channel bed of each channel bar with transverse slots corresponding to the tongues; and wherein the step of connecting the bar coupler is by inserting said tongues into their corresponding slots and bending said tongues behind said slots to secure said coupler to said other channel bar.

6. The method of according to claim 1, further comprising providing the wings of said channel bars with spaced transverse slots; and wherein the steps of mounting the transverse members comprises inserting ends of said transverse members to be mounted into said spaced transverse slots.

7. The method according to claim 1, wherein the step of mounting panels comprises piercing said insulating pieces with members, two ends of each of which define two hooks engaging wire panels on opposite sides of said insulating pieces, and securing said panels to said channel bars by slotted clips each of which has an open slot that allows the entry of a wire of the wire panel and a portion to hold itself to the channel bar.

8. The method according to claim 1, further comprising corrugating a bed of the channel of said channel bar to have a wavy structure in longitudinal section.

9. The method according to claim 4, further comprising forming in each said channel bar a recess in the vicinity of proximal edges of said wings, and forming on each bar coupler at the position corresponding to said recess, a projection that can fit into said recess.

10. The method according to claim 1, wherein said channel bar has a substantially H-shaped cross-section.

* * * * *